United States Patent [19]

Fries

[11] 4,311,324

[45] Jan. 19, 1982

[54] SKATING SAILS

[76] Inventor: James E. Fries, 1530 Fulton Ave., Apt. 84, Sacramento, Calif. 95725

[21] Appl. No.: 108,570

[22] Filed: Dec. 31, 1979

[51] Int. Cl.[3] ..... A63C 11/00

[52] U.S. Cl. ..... 280/810; 114/103

[58] Field of Search ..... 280/810, 809, 11.19, 280/213, 87.04 A; 180/180, 181; 114/39, 103

[56] References Cited

U.S. PATENT DOCUMENTS

| | | | |
|---|---|---|---|
| 1,178,165 | 4/1916 | Lupton, Jr. | 280/810 |
| 1,859,178 | 5/1932 | Sprinkle | 280/810 |
| 3,830,512 | 8/1974 | Spiegel | 280/810 |
| 4,204,694 | 5/1980 | Freeman | 280/810 |

FOREIGN PATENT DOCUMENTS

| | | | |
|---|---|---|---|
| 169440 | 11/1951 | Austria | 280/810 |

OTHER PUBLICATIONS

"Austrian's Ski Sail Permits Long Leaps", *Popular Mechanics,* Jan. 1953, p. 155.

*Primary Examiner*—Joseph F. Peters, Jr.
*Assistant Examiner*—Donald W. Underwood
*Attorney, Agent, or Firm*—Edward A. Sokolski

[57] ABSTRACT

A sail device for use in propelling a roller skater, ice skater or the like employs a balancing pole from which the sail material is suspended. The sail may be formed in two sections which come together near the center of the pole or may be formed in a single section with cut-outs near the center thereof to accommodate the hands of the user. The sails are generally triangular in shape, the lower corners of the sail sections, where dual sails are used, being removably attached to the shoes of the user as at the shoelaces thereof, and in the case of a single sail section, attachment being made to the user's shoe or a skateboard at or near the bottom apex portion of the triangle. In use, the user grasps the balance pole near the center thereof and suspends the sails in a desired position for propulsion by the wind.

19 Claims, 7 Drawing Figures

SKATING SAILS

This invention relates to a sail device for use in the wind propulsion of a roller skater, ice skater, skateboarder or the like, and more particularly to such a device employing a sail structure mounted on a balancing pole which is held by the user.

Devices have been developed in the prior art for propelling skates, these being typified by the devices described in U.S. Pat. No. 2,793,870 to R. R. Bowman and U.S. Pat. No. 1,178,165 to B. M. Lupton, Jr. The device of the Bowman patent involves a singlesection sail mounted on a triangular frame which is held in one hand by the user. This single sail device, while economical in its construction, has distinct limitations, first in the limited amount of sail area that it provides, and secondly in that it appears to provide limited maneuverability for the user. The Lupton device involves a pair of sails which are supported from the user's outstretched arms and attached to the user's body at ankles, waist and shoulders. This device, while providing substantially greater sail area than that of Bowman, requires that the user hold his arms in an outstretched position to support the sails which is somewhat fatiguing. Further, it is somewhat difficult to maneuver effectively and to provide as much sail surface as to be desired in view of the limited lateral extent of the user's arms. U.S. Pat. No. 2,213,754 to H. Thirring describes a braking sail for use in skiing which uses a one piece sail with stiffened portions which are extended outwardly by the user's arms. This device has the same shortcomings as Lupton, i.e., lack of maneuverability and fatigue to the user.

The device of the present invention provides a substantial improvement over prior art sails suitable for use by roller skaters, ice skaters, skateboarders and the like. This improvement is achieved by employing an elongated balancing pole on which the sail is supported within a casing formed along the top edge of the sail. The pole may be collapsible for ease of its transportation. The sail may come in two sections which are generally triangular in configuration, or may come in a single piece. The bottom corners of the triangular sails are coupled below waist level, preferably to the area of the user's legs. In the preferred embodiment, such attachment is made to the shoelaces of the user's shoes. In the case of a skateboard, an effective coupling can be achieved by connecting the lower end of the sail to the skateboard or by utilizing the skater's shoestrings. To reduce the weight of the sails the user himself forms part of the working assembly. Functioning as an effective mast near the center of the balancing pole, which is grasped by the user and held aloft, the user manipulates the pole to catch the wind and maintain balance. The sails are made completely flexible in the leg regions which permits ample leg motion for skating, while quick release devices are provided for convenient removal of the lower corners of the sails from the user's shoelaces. With the device of the present invention, small children can "skate sail" while maintaining balance and maneuverability even in strong gusts of wind without previous knowledge of sailing techniques, and with a minimum amount of practice.

It is therefore an object of this invention to provide an improved sail device for use in propelling a skater.

It is another object of this invention to provide a skating sail device with an effective balancing means.

It is still another object of this invention to provide large wind-catching areas in a sailing device without sacrificing balance and maneuverability.

It is a further object of this invention to provide a skating sail device with large sail areas which are also flexible in the leg areas to allow normal skating leg movements.

It is still a further object of this invention to provide an effective skating sail device which is simple, inexpensive and lightweight.

It is yet a further object of this invention to provide a propulsion sail for use by a skater employing a balancing pole from which the sail is suspended, which pole is manually supported by the user thereof.

Other objects of this invention will become apparent as the description proceeds in connection with the accompanying drawings of which:

Figure 1:
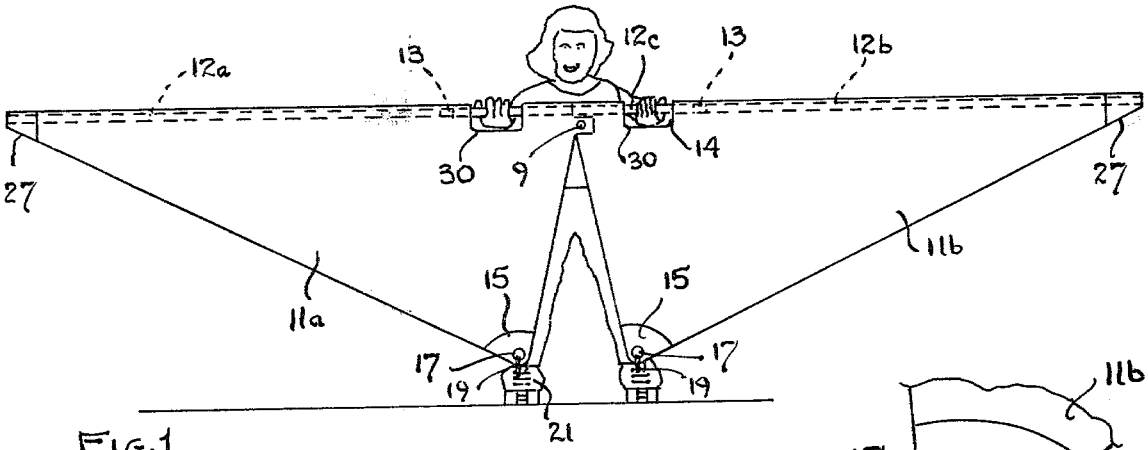
FIG. 1 is a front elevational view illustrating a preferred embodiment of the invention in use.
Figure 2:
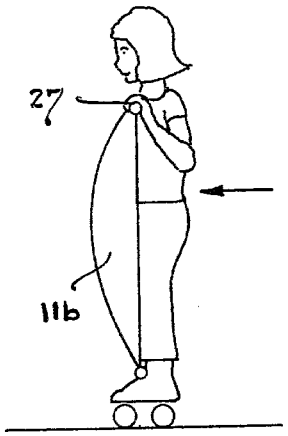
FIG. 2 is a side elevational view of the preferred embodiment.
Figure 3:
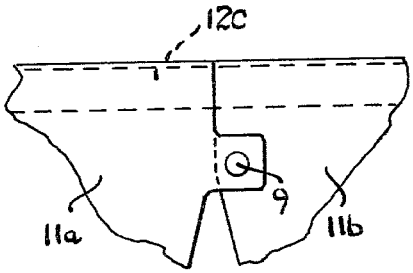
FIG. 3 is an enlarged view illustrating the snap attachment for the dual sail sections of the preferred embodiment.
Figure 4:
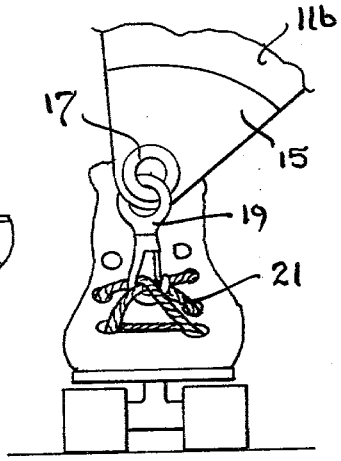
FIG. 4 is an enlarged view illustrating a spring clip employed in the preferred embodiment.
Figure 5:
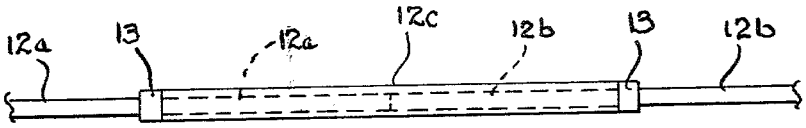
FIG. 5 is an enlarged view illustrating a pole connector device which may be employed in the preferred embodiment.
Figure 7:
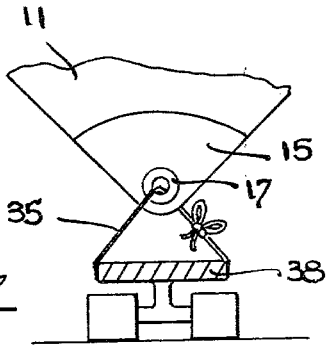
FIG. 7 is an enlarged view illustrating a string skateboard attachment which may be employed in the alternate configuration of the device of the invention.

Referring now to FIGS. 1–5, a pair of flexible sail sections 11*a* and 11*b* are suspended from balancing pole 12. The sail sections may be fabricated of flexible plastic or cloth material such as nylon, dacron, etc. having casings 14 formed along the top edges thereof in which the balance pole 12 is fitted. A snap connector 9 is provided to join the top central portions of the sails as indicated in FIG. 3. The sail sections 11*a* and 11*b* are triangular in shape and may have a pair of reinforcing sections 15 near the lower edges thereof which sections may be fabricated of a suitable durable material such as denim, plastic, canvas, etc. The balancing pole 12, which has a portion near the center adapted to be held in the hands of the user, is preferably fabricated in a pair of sections 12*a* and 12*b* which are joined together at their centers with a tube 12*c* into which pole sections 12*a* and 12*b* telescopically fit, as indicated in FIG. 5. Sleeves 13, which function as centering stop members for the tube, are fixedly attached to poles 12*a* and 12*b*. The balancing pole may be fabricated of fiberglass, metal tubing, bamboo or other wood material, etc. The pole sections should be of a diameter suitable for convenient grasping by the hands of the user, who, as noted, may be a child. Metal eyelets 17 are attached to the bottom reinforced corners 15 of each of the sail sections and a spring clip 19, as can best be seen in FIG. 4, is fitted through each of these eyelets 17. The spring clips are removably attached to the shoelaces 21 of the user. Other suitable means can be employed for attaching the sail to the user's legs, as for example a piece of string 35, as shown in FIG. 7, or other type of attachment device. It is also to be noted that in the case of a skateboard, the bottom portion of the sail section could be tied to the board with a string or with an attachment device mounted on such board. The two corners of the sail which are on pole 12 are covered with skids 27. These end skids may be fabricated of a suitable abrasion resistant material such as a suitable rubber or plastic coated cloth or thick denim material sewn onto the sail. The skids can be used for braking by dragging one of the skids on the ground. Rubber or plastic caps, snugly fitted on the ends of the poles, could also be used for this purpose. In the embodiment illustrated in FIGS. 1–5, central portions 30 of sail 11 are cut out to enable the grasping of the pole by the user. These cut-outs are not essential, but are preferred so that the user's hands can more firmly grip the pole. While the pole has been shown formed in two pieces (and can be made in more than two pieces) for ease of transportation, it can be fabricated in a single piece. Also, the pole 12 can be tapered toward the ends if desired. Further, the bottom portions of the sails can be slightly rounded to give more surface area to the sail.

Figure 6:
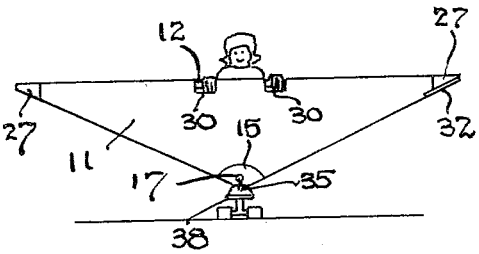
FIG. 6 is a front elevational view of an alternate configuration of the device of the invention employing a single sail.

Referring now to FIGS. 6 and 7, a modification of the invention is shown, this modification employing a single sail 11 rather than a pair of sail sections. A zipper 32 is provided in the sail casing end 27 for facilitating the insertion of the balancing pole 12. The bottom reinforced corner 15 of the sail 11 is removably attached to skateboard 38 by means of string 35 which is fitted through eyelet 17, the eyelet being attached to reinforced corner 15. The string runs around the skateboard and is tied, as best shown in FIG. 7.

In use, the balancing pole 12 is grasped through the cut-outs 30 by the user and maneuvered as may be desired to achieve propulsion and balance with the wind. Braking can be accomplished by dragging one or the other of the end skids on the ground.

While the invention has been described and illustrated in detail, it is to be clearly understood that this is intended by way of illustration and example only and is not to be taken by way of limitation, the spirit and scope of this invention being limited only by the terms of the following claims.

I claim:

1. A sail device for use in propelling a skater on skate means comprising an elongated balancing pole having a length substantially greater than the outstretched extent of the skater's arms, a flexible sail suspended from said pole in a symmetrical manner, and means for removably coupling predetermined bottom portions of said sail to the legs of the skater, whereby central portions of said pole are adapted to be grasped by the skater and the sail held in a position so as to catch the wind.

2. The sail device of claim 1 wherein the sail is formed in two similar, generally triangular sections.

3. The sail device of claim 1 wherein said means for removably coupling said sail to the legs of the skater comprises quick release means for connecting the sail to the shoelaces of the skater.

4. The sail device of claim 1 and further including abrasion resistant means on opposite corners of said sail.

5. The sail device of claim 4 wherein said abrasion resistant means comprises thick cloth sewn on opposite corners of the sail.

6. The sail device of claim 3 wherein said quick release means comprises spring clips.

7. The sail device of claim 1 wherein the sail has a casing formed along the top edge thereof in which said pole is fitted.

8. The sail device of claim 7 wherein said casing has cut-out portions near the center thereof exposing portions of the pole to form hand-grasps for the skater.

9. The sail device of claim 1 wherein the means for removably coupling the sail to the legs of the skater comprises a string fitted through the bottom of the sail and running around the skate means.

10. A sail device for use in propelling the user on skate means comprising an elongated balancing pole having a length substantially greater than the outstretched extent of the user's arms, flexible sail means suspended from said pole with exposed portions being provided near the center of said pole for grasping by the user and means for removably attaching the lower extremities of said sail means to said skate means, whereby the user holds said pole with the sail means extending above the skate means for propulsion of the user.

11. The device of claim 10 wherein the sail means is generally triangular in configuration, with the apex portions of the triangle being connected to the skate means.

12. The device of claim 11 wherein said means for connecting the lower ends of said sail means to said skate means comprises a pair of clip members which engage the shoelaces of the user.

13. The device of claim 11 wherein said sail means comprises a pair of triangular sail sections at least partially separated from each other at the central portions thereof.

14. The device of claim 10 and further including skid means at the corners of the sail and adjacent to the ends of said pole for braking when being dragged against the ground.

15. The device of claim 11 wherein said sail means is formed by a single triangular sail.

16. The device of claim 11 wherein said sail means is formed by a pair of similar triangular sail sections.

17. The device of claim 16 and further including reinforcing section means attached to the lower corners of said sail sections.

18. The device of claim 10 wherein said balancing pole is formed in two sections which are removably joined together.

19. The device of claim 16 and further including snap means for removably joining the upper center portions of said sail sections together.

* * * * *